United States Patent [19]

Schuda et al.

[11] Patent Number: 4,940,922

[45] Date of Patent: Jul. 10, 1990

[54] INTEGRAL REFLECTOR FLASHLAMP

[75] Inventors: Felix Schuda, Cupertino; Roy D. Roberts, Newark, both of Calif.

[73] Assignee: ILC Technology, Inc., Sunnyvale, Calif.

[21] Appl. No.: 809,297

[22] Filed: Dec. 16, 1985

[51] Int. Cl.[5] ..... H05B 41/30

[52] U.S. Cl. ..... 315/246; 313/113

[58] Field of Search ..... 313/43, 326, 113, 570, 313/634, 632, 336, 246, 244, 252, 568, 620, 621, 631, 572, 573, 574, 634, 231, 71; 315/246, 178, 113, 241 R, 324, 232, 200 A, 241 P, 241 S

[56] References Cited

U.S. PATENT DOCUMENTS

| | | | |
|---|---|---|---|
| 2,673,944 | 3/1954 | Francis | 313/572 |
| 3,452,231 | 6/1969 | Sell | 313/572 |
| 3,495,118 | 2/1970 | Richter | 313/113 |
| 3,733,599 | 5/1973 | Fantozzi | 315/241 S |
| 3,911,375 | 11/1975 | DeMaria et al. | 313/231.01 |
| 3,953,763 | 4/1976 | Herrick | 315/241 S |
| 4,469,991 | 9/1984 | McAllister | 315/246 |

*Primary Examiner*—David K. Moore

*Attorney, Agent, or Firm*—Thomas E. Schatzel

[57] ABSTRACT

A short-arc flashlamp of the type having an internally integral reflector including an anode and cathode member mounted to extend along a central axis of symmetry of the lamp and having distal ends spaced apart to define a short-arc gap. The lamp is driven by current pulses such that the average peak currents across the arc gap exceed about one hundred amperes in pulses ranging from about two to ten microseconds.

4 Claims, 1 Drawing Sheet

INTEGRAL REFLECTOR FLASHLAMP

BACKGROUND OF THE INVENTION

1. Field of the Invention

The present invention relates generally to arc lamps and, more particularly, to arc lamps of the type which have short-arc gaps and integral, internal reflectors.

2. Description of the Prior Art

It is well known to utilize lamps having short-arc gaps and integral internal reflectors to provide compact yet intense point sources of light. Such lamps are utilized for example, in medical and industrial endoscopes. Generally speaking, such lamps include a sealed chamber which contains a gas pressurized to several atmospheres, an anode and cathode mounted along the central axis of the chamber to define an arc gap, an integral concave reflector which collimates light generated at the arc gap, and a window at the mouth of the concave reflector to permit external transmission of the collimated light from the reflector. When utilizing direct current to power such lamps, it is known to operate the lamps in a pulsed, low current manner. During non-pulsed operation, a small current (known as the simmer current) is provided to the lamp until such time as the lamp is pulsed; then the current is increased to as much as one-hundred amperes, averag% peak. In one mode of operation, for example, the pulses are generated about one every 1.5 seconds and each pulse has a duration of about 100 milliseconds (i.e., one-tenth second), resulting in an energy flow across the short-arc gap of several hundred joules for the duration of the pulse with the average current being about one-hundred amperes. Typical voltages required for starting such lamps are approximately 12,000 volts.

It is also known in the art to utilize short-arc lamps which do not have integral internal reflectors but, instead, have external reflectors. Such lamps are typically filled with xenon at pressures of several atmospheres when the lamp is cold; during operation, gas pressure within the lamp may triple. Further, it is known to operate such lamps with either relatively high or relatively low current pulses. When operated with high currents and short duration pulses, such lamps with external reflectors can be characterized as flashlamps. A disadvantage of such flashlamps with external reflectors, especially reflectors made of aluminum, is that oxides invariably form on the reflector surface. Such oxides have been found to absorb short wave length light, such as ultraviolet light, and therefore, seriously degrade the spectral performance of the lamp when the lamps are operated with relatively high current pulses.

SUMMARY OF THE INVENTION

A primary object of the present invention is to provide a short-arc flashlamp of the type having an internally integral reflector.

In accordance with the preceding objects, the present invention provides a flashlamp having a hollow body, a concave reflector fitted within the body to define a curved reflecting wall symmetrical about a central axis of the lamp; a transparent window assembly sealingly mounted to the body transverse to the central axis to maintain pressurized gas within the space encompassed by the curved reflector and to pass collimated light from the lamp; first and second opposed electrode members, comprising an anode and a cathode, mounted to extend along the central axis and located to define a short arc gap at the focal point of the concave reflector; and means to convey current pulses to the electrodes to provide luminescent flow of electrons across said short-arc gap between the opposed ends of the cathode and anode at average peak currents exceeding about one hundred amperes for individual pulse periods ranging in duration from about two to ten microseconds, to provide a flashing luminescent flow of electrons between the tips of the first and second electrodes.

Accordingly, a primary advantage of the present invention is the provision of a short-arc flashlamp of the type having an integral internal reflector.

This and other objects and advantages of the present invention will no doubt become obvious to those of ordinary skill in the art after having read the following detailed description of the preferred embodiment which is illustrated in the various drawing figures.

IN THE DRAWINGS

FIG. 1 is a side view, in axial section, of a lamp system according to the present invention; and FIG. 2 is an end view of the lamp of FIG. 1 taken along the line 2—2 for viewing in the direction of the arrows; and FIG. 3 is a graphical depiction of relative spectral radiance versus wavelength of output light.

DETAILED DESCRIPTION OF THE PREFERRED EMBODIMENT

Figure 1:
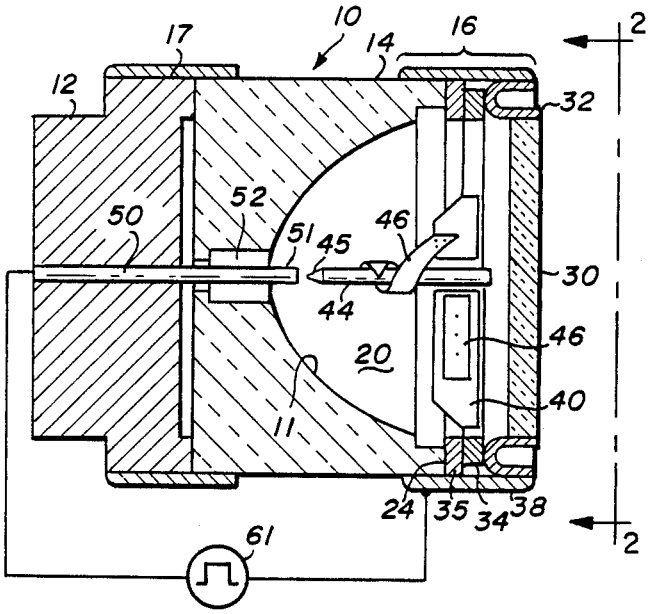
Figure 2:
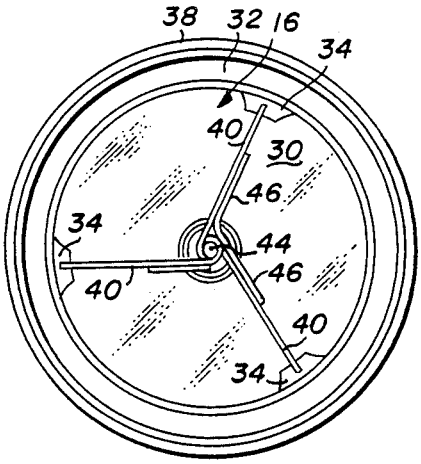

FIGS. 1 and 2 illustrate a short-arc flashlamp, generally designated by the reference character 10, of the type having an integral internal reflector 11. The lamp 10 includes a metallic base member 12, a body section 14 formed of a dielectric material which defines the internal reflector 11, and a window assembly generally designated by the reference character 16. The internal reflector 11, the base 12, the body section 14, and the window assembly 16 are all generally circular in transverse cross-section, and are generally symmetrical about the longitudinal central axis of the lamp 10. The base 12 is secured to the body 14 by a cylindrical metallic band 17 which overlappingly surrounds both the body and the base. The base 12 functions both as a heat sink for the lamp and as an electrical conductor to carry current to the lamp. In practice, the base 12 is often formed of iron, which material is chosen for its electrical and thermal conductivity characteristics.

The body 14 of the lamp 10 of FIGS. 1 and 2 includes a hollow concave cavity 20 which defines the reflector 11. Like the other components of the lamp 10, the reflector 11 is symmetrical about the longitudinal central axis of the lamp 10. In practice, the reflector 11 may be parabolic, elliptical or aspherical in shape to provide a particularly desired collimation of light. Typically, the reflector 11 has a reflective metal coating deposited thereon. The reflector 11 can be formed as part of the body 14 or can be a separate piece which, nevertheless, is internally integral to the lamp 10.

The window assembly 16 is sealingly secured across the mouth 24 of the cavity 20 traverse to the central axis of the lamp 19. The window assembly 16 serves to pass collimated, high-intensity light from the lamp 10. In the illustrated embodiment, window assembly 16 includes a transparent circular window 30 formed, for example, of a sapphire disk. The outer periphery of circular window 30 is sealing surrounded by a flange member 32 which is U-shaped in radial cross-section (FIG. 1) and which has an inside diameter which snugly receives the circular window 30. In the assembled condition of the lamp 10, a metallic spacer ring 34 and a ceramic spacer ring 35 are interposed between the U-shaped flange 32 and mouth 24 of the concave cavity 20; to secure the window assembly to the body, a cylindrical metal band 38 overlappingly surrounds the U-shaped flange 32 and the body 14. As so constructed and assembled, the interior of the cavity 20 is hermetically sealed.

The window assembly 16 of FIGS. 1 and 2 further includes three support struts 40 which are positioned to extend radially inward across the face of the window 30 toward the axial centerline of the lamp 10. The struts 40 are electrically conductive and are fixed, as by brazing, at their outer ends to the metallic spacer ring 34. At their radially inward ends, struts 40 support a rod-shaped cathode member 44 which, in turn, extends along the axial centerline of lamp 10 toward the focal point of reflector 11. Preferably, cathode member 44 is circular in cross-section and, at its distal end, tapers to a tip 45 adjacent the focal point of the cavity 20.

As further shown in FIGS. 1 and 2, strips of metal 46, called "getters", can be secured to the struts 40 and the cathode member 44. The getters 46 are typically fabricated of zirconium and are provided to absorb impurities formed within the cavity 20 during operation of the lamp 10. Such impurities may be generated, for example, by outgassing of materials from the body 14 when the interior of the lamp reaches high temperatures.

The lamp 10 of FIGS. 1 and 2 further includes an anode member 50 which extends along the central axis of the lamp from the base 12 to a location adjacent the focal point of the reflector 11. The anode member 50 is circular in cross-section and terminates in a blunted distal end 51. The distance between the end 51 of the anode member 50 and the tip 45 of the cathode member 44 defines the arc gap. In practice, the arc gap distance is less than about one centimeter.

In accordance with the present invention, the lamp 10 is operated as a flashlamp by periodic high current pulses. More specifically, the average peak currents through the lamps of the present invention exceed about one hundred amperes, and such currents are provided in pulses, each of which has a duration of about two to ten microseconds. Such pulses can be provided, for example, by a rapidly pulsating current source 61 electrically connected between the anode 50 and the cathode 51.

Thus, in operation of the lamp 10 of FIGS. 1 and 2, the cavity 20 is filled with inert gas, such as xenon, at a pressure ranging from less than about two atmospheres to a fraction of an atmosphere. (Conventional short-arc lamps having integral internal reflectors typically have internal gas pressure exceeding about seventeen atmospheres.) The lamp 10 is illuminated when the current pulse causes breakdown voltage to be exceeded across the arc gap, thereby resulting in an illuminating flow of electrons from the tip 45 of the cathode member 44 to the end 51 of the anode member 50. Typically, the required triggering voltage for such lamps exceeds about seven thousand volts. The light which emminates from the electrical discharge across the arc gap is collimated by the reflector 11 and passes outward through the window 30. In practice, the tip 45 of the cathode member 44 and the end 51 of the anode 50 are sized and arranged such that the voltage during discharge across the arc gap ranges from about one hundred to fifteen hundred volts at the time of discharge. Typical peak current flow across the arc gap ranges from about 200 to 600 amperes or higher.

Figure 3:
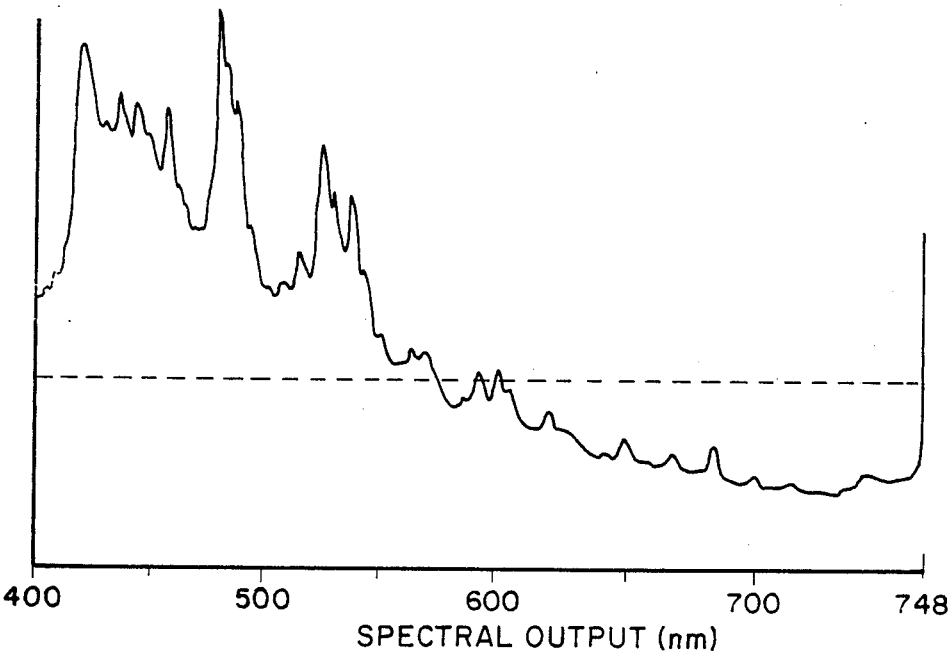

It should be appreciated that the current densities across the short-arc gap of the lamp of the present invention are relatively high and, as compared to prior art pulsed arc lamps of the integral internal reflector type, exceed current densities at the arc gaps of such lamps by an order of magnitude. Thus, a lamp operated according to the present invention at high current densities can be characterized as a flashlamp. One result of such high current densities is to increase the brilliance of the output of the flashlamp of the present invention as compared to conventional low-current pulses arc lamps having internal reflectors. Another even more significant result is to significantly change the spectral characteristics of the output of the flashlamp of the present invention as compared to conventional low-current pulsed arc lamps of the internal reflector type. Whereas low-current pulsed lamps provide essentially the same spectral output as short-arc lamps operated under DC conditions, the flashlamp of the present invention provides spectral outputs which are significantly higher in the blue and ultraviolet spectral range. Such enhanced performance of a flashlamp according to the present invention is shown in FIG. 3 which depicts the relative spectral radiance of a one hundred and fifty watt lamp operated to provide a five microsecond flash at peak current of about six hundred amperes. The lamp was filled to a pressure of about 1.5 atmospheres with an inert gas (xenon).

The horizontal axis of the graph in FIG. 3 is the wavelength of output light measured in nanometers, and the vertical axis shows the relative spectral output at each wavelength. The dashed horizontal line indicates the typical relative spectral output of a low-current pulsed-type short-arc lamp.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A flashlamp having a short-arc comprising:

a hollow body member;

a concave reflector fitted within the body member to define a curved reflecting wall symmetrical about a central axis of the lamp;

a window assembly including a transparent window sealingly mounted to the body member to maintain pressurized inert gas within the space encompassed by the curved reflector and to pass collimated light from the lamp;

inert gas enclosed within the space encompassed by the curved reflector and the window assembly and maintained at a pressure of less than two atmospheres;

first and second opposed electrode members, mounted to extend along said central axis with the distal ends of said electrodes being spaced apart from one another in opposed relationship to define a short-arc gap at the focal point of the concave reflector; and pulse-producing means connected to the respective electrodes to provide current pulses to the electrodes to practice a luminescent flow of electrons across said short-arc gap between the distal ends of the first and second electrodes, which pulses provide peak currents exceeding about two hundred amperes and which each have durations ranging from about two to ten microseconds.

2. A short-arc flashlamp according to claim 1 wherein, the distance between said opposed distal ends of the anode and cathode is less than about one centimeter.

3. A short-arc flashlamp according to claim 1 wherein, the current pulses provided to said electrodes are about five microseconds in duration.

4. A short-arc flashlamp according to claim 3 wherein, said transparent window is formed from sapphire.

* * * * *